US005172812A

United States Patent [19]

Wharton et al.

[11] Patent Number: 5,172,812

[45] Date of Patent: Dec. 22, 1992

[54] CHILD-RESISTANT PAPERBOARD BLISTER PACKAGE AND METHOD OF MAKING THE SAME

[75] Inventors: B. G. Wharton, Buffalo Grove, Ill.; Daniel Lagerfeldt, Stratford; Alan Johnston, New Haven, both of Conn.

[73] Assignee: Rexham Corporation, Del.

[21] Appl. No.: 824,344

[22] Filed: Jan. 23, 1992

[51] Int. Cl.[5] ..... A61J 1/00

[52] U.S. Cl. ..... 206/531; 206/469; 206/532

[58] Field of Search ..... 206/467–469, 206/528, 531, 532, 539, 820

[56] References Cited

U.S. PATENT DOCUMENTS

| | | | |
|---|---|---|---|
| Re. 29,705 | 7/1978 | Compere | 206/532 |
| 3,921,805 | 11/1975 | Compere | 206/532 |
| 3,924,747 | 12/1975 | Gerner | 206/531 |
| 4,243,144 | 1/1981 | Margulies | 206/532 |
| 4,537,312 | 8/1985 | Intini | 206/820 |
| 4,574,954 | 3/1986 | Reid | 206/532 |
| 4,988,004 | 1/1991 | Intini | 206/469 |

*Primary Examiner*—Jimmy G. Foster

*Attorney, Agent, or Firm*—Schweitzer Cornman & Gross

[57] ABSTRACT

A child resistant blister package includes a top sheet of paperboard having apertures. A thermoformed plastic sheet includes blisters which project through the apertures. A sheet of rupturable material closes off each blister. A bottom sheet of paperboard material is peelably laminated to the sheet of rupturable material. The bottom sheet includes a removable strip being defined by a continuous cut and having a pull-tab. The top sheet includes a severable pull tab extension. A tablet in a respective blister is removable therefrom by pressure being applied at a limited region of the blister, along the edge of the blister closest to the pull-tab, to rupture the rupturable sheet material. The tablet is not removable by pressure applied at a region remote from the pull tab.

2 Claims, 2 Drawing Sheets

CHILD-RESISTANT PAPERBOARD BLISTER PACKAGE AND METHOD OF MAKING THE SAME

BACKGROUND AND SUMMARY OF THE INVENTION

Child-resistant packaging of drugs has been long available to the pharmaceutical industry. Such packaging has typically introduced impediments to gaining access to the packaged drug by children while providing access to the drugs to adults who are able to follow instructions for manipulation of the package in a manner that is not too difficult, yet which will deter opening by children.

Tablets have been individually blister packaged in a variety of child-resistant packages which have met with some degree of success and acceptance in the market place. Exemplary of one type is the so-called "Peel-push" concept of child-resistant packaging in which tablets are contained in individual flexible blisters sealed by a rupturable foil material, access to which tablets are selectively obtained by peeling off a protective layer to expose the rupturable material and to permit the tablet to be pushed through the rupturable material by pressure on the blister. Examples of commercially acceptable packages having such a "peel-push" feature are illustrated in U.S. Pat. No. 4,125,190 and U.S. Pat. No. Re. 29,705.

There has been a need for an all paperboard package utilizing "peel-push" child-resistant opening. However, heretofore such packaging has not been available to the pharmaceutical packaging industry. It is to the development and provision of a method of making such a "peel-push" paperboard package and the resulting package itself to which the present invention is directed.

The design of a "peel-push" package shown in U.S. Pat. No. Re. 29,705 involves the use of paper/foil or plastic/foil lamination where the paper or plastic surface is pealed back and the product is pushed through the foil once it is exposed. (However, this construction does not provide the aesthetics of a paperboard blister card.) Users of such packaging who desire to incorporate this concept into a paperboard blister card have been limited to a single option; namely, trap sealing a paper/foil/plastic packette into a paperboard card. The design shown in the U.S. Pat. No. 4,125,190 uses a continuous perforation on the back of the paperboard blister card which is only sealed to the outer edge of the foil and is opened by pulling back the perforated tear opening strip. However, the design utilizes a backing sheet which traps a preformed plastic foil package and does not provide a positive seal to the entire inner side of the foil. Moreover, with the designs shown in both of the aforementioned patents, once the top substrate has been peeled back to expose the rupturable foil, the product may be removed from the blister by pushing or collapsing any part of the flexible plastic dome or blister.

In accordance with the principles of the present invention, the shortcomings of the aforementioned constructions have been overcome through a new and improved manufacturing process and package design. Specifically, the incorporation of a "peel-push" child-resistant feature into an all paperboard card has been made possible by the manufacture of a paperboard product which may be readily peeled from both plastic and foil. In accordance with the concepts of the present invention this has been accomplished by applying peel/- seal coating systems known for paper and lidding stock in the medical device field to a non-corona treated polyethylene coated paperboard. The use of non-corona treated polyethylene coated paperboard is very important, since corona treated polyethylene boards promote sealability in contrast to the characteristics of non-treated board, i.e., non-treated board prevents fiber contact with the coating and helps facilitate the "peel-seal" characteristics desired.

Moreover, in accordance with the principles of the present invention the comparative ease of removing a product by collapsing any part of the entire flexible dome of the thermo-formed blister, thereby limiting the degree of child-resistance, is overcome by removing only a portion of the paperboard closing off the bottom of the blister or only a fraction of the area of the dome. By only exposing a portion of the total covering of rupturable material of the dome opening, removal of the tablet requires specific selective pushing on the dome on one side only to expel the packaged drug. This makes it much more difficult for a child to remove the product by chance by pushing any portion of the dome. Rather, a selectively focused push on a specific portion of the blister, rather than on any portion, is required to gain access.

The new method by which the board stock for such a new package is manufactured involves scoring and die cutting the paperboard prior to laminating the foil. Current manufacturing techniques for "peel-push" stock do not permit independent paper die cutting from existing paper/foil lamination since the paperboard and the plastic are laminated together prior to die cutting, making it impossible to die cut the lid stock separately. Thus, in accordance with the principles of the present invention, the paperboard is die cut prior to its being laminated to the foil, the die cutting being to the specific configuration required to provide only limited exposure of the rupturable dome sealing material. The employment of this particular method of die cutting before foil lamination will enable improvements in "child resistance" to be made to many existing "peel-push" package designs.

For a better and more complete understanding of the present invention and a better appreciation of its attendant advantages, reference should be make to the following detailed description taken in conjunction with the accompanying drawings.

DETAILED DESCRIPTION OF THE INVENTION

Figure 1:
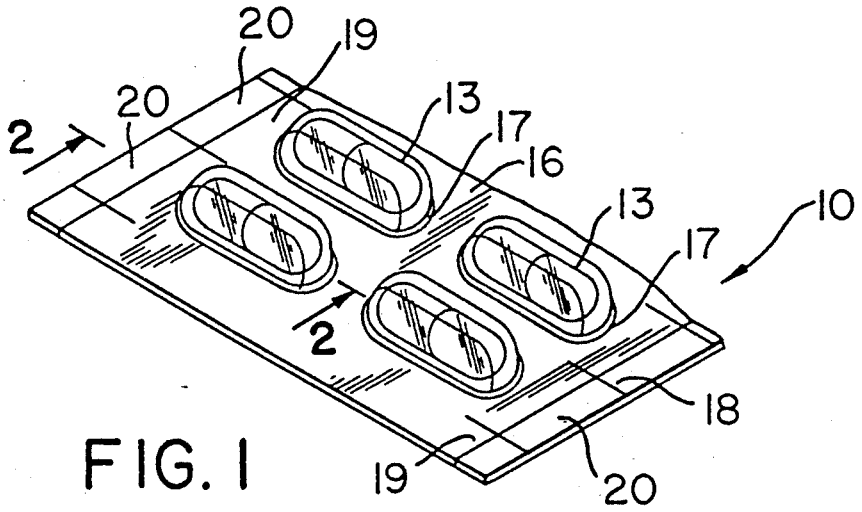
FIG. 1 is a perspective view showing an end portion of a child-resistant blister package incorporating principles of the present invention.
Figure 2:
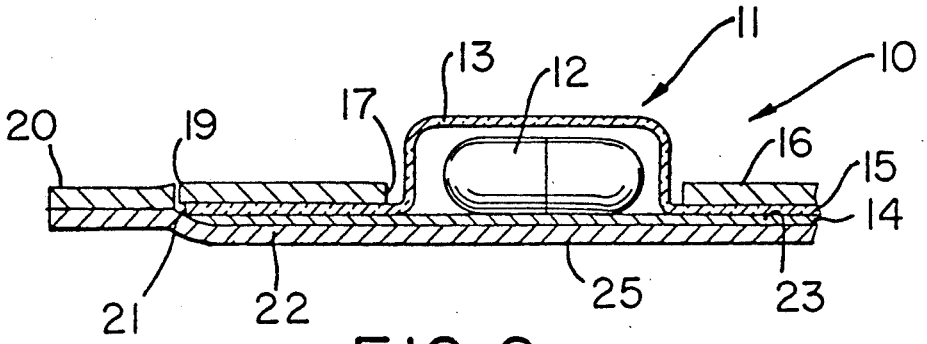
FIG. 2 is a cross-sectional view taken along line 2—2 of FIG. 1.
Figure 3:
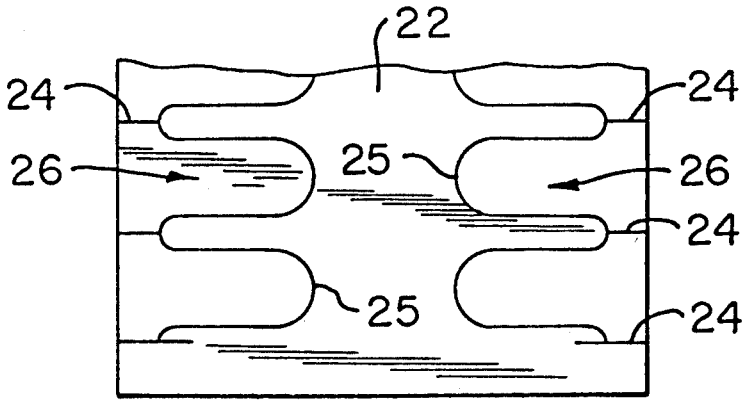
FIG. 3 is a fragmentary view showing the bottom of the package of FIG. 1 and the scoring of the bottom paperboard layer of the new package.

Referring now to FIGS. 1 and 2, the new child-resistant paperboard blister package 10 includes a packette 11 of tablets 12 which packette is comprised of a thermoformed series of blisters 13 arranged in rows having a predetermined number of blisters. For example, a packette may include 12 tablets disposed in two rows of six blisters. The packette 11 further includes a rupturable aluminum foil 14 which is sealed to the planar portions 15 of the thermoplastic blister sheet. It is to be understood that packettes of this general configuration are well known to the pharmaceutical industry and are the basis of other child-resistant packaging of tablets.

In accordance with the principles of the present invention an improved all paperboard carrier is provided for such known packettes, which carrier has child-resistant opening features and which is positively sealed across the entire packette. The packettes 11 are sandwiched between a supporting upper layer of polyethylene-coated paperboard 16 which is provided with a series of apertures 17 through which the blisters 13 project, as will be understood. The lateral edges of the supporting sheet 16 are cut by lines 18 and 19 to form tear-away opening tabs 20. Each tear-away tab 20 as shown in FIG. 2 is associated with a proximate blister 13. More specifically and as shown in FIG. 2 the tabs 20 project beyond the edge 21 of the packette 13.

In accordance with the principles of the present invention, a sealed opening layer of specially coated paperboard 22 is laminated to the bottom surfaces of the packette 13 and the supporting layer 16 by a special peel-seal adhesive coating 23.

Figure 4:
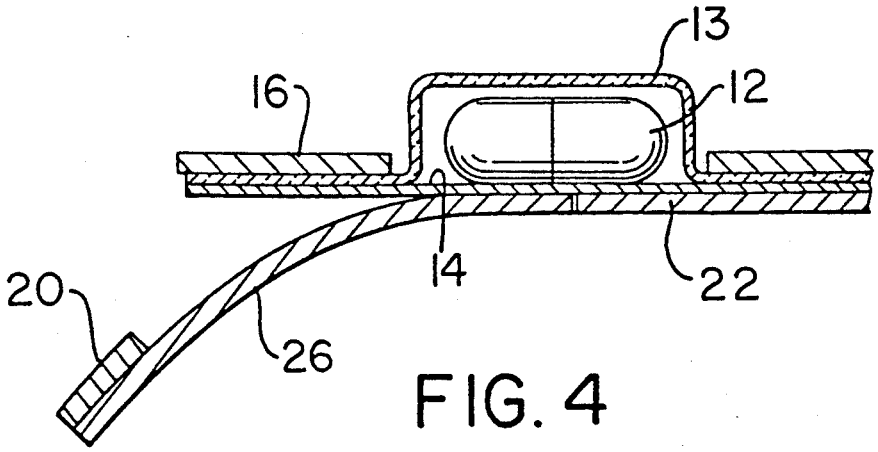
FIG. 4 is a cross-sectional view showing the initial step of opening the new blister package.
Figure 5:
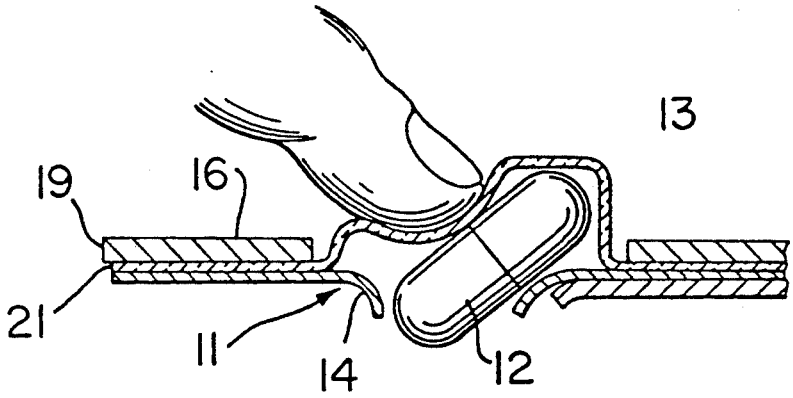
FIG. 5 is a cross-sectional view showing the second step of removing a tablet from the new package.
Figure 6:
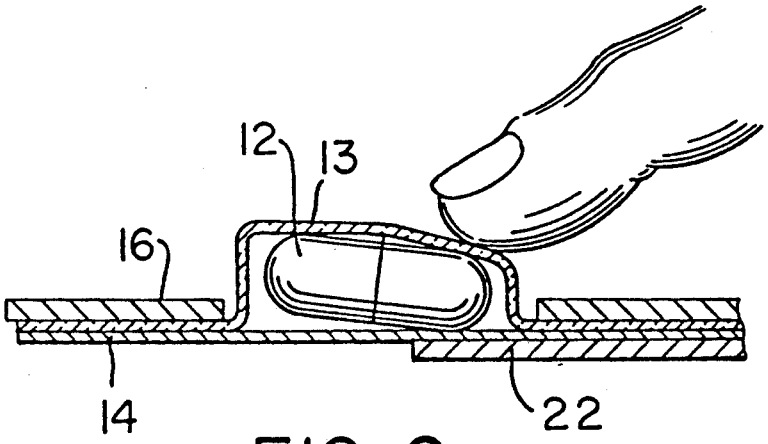
FIG. 6 is a cross-sectional view showing the non-removal of a tablet when pressure is improperly applied to the dome of the new package.

In accordance with the principles of the present invention, the bottom layer 22 is specially die cut by cuts 24, 25 to form removable tab portions 26. The tab portions 26 are "misregistered" with the openings 17 and the packettes 13 in such a manner that when the tab 26 is peeled from the foil layer of the packette 11 by grasping the tab portion 20 as shown in FIG. 4, and peeling the combination of the tab member 20 and tab portion 26 away from the packette 11 as shown in FIG. 4, to expose the foil rupturable foil layer 14. A tablet 12 may be removed from the new package only by applying pressure to the end of the blister 13 which is juxtaposed above that portion of the package which does not have paperboard 22 disposed beneath the blister 13. This is shown in FIG. 5 where application of finger pressure to the blister will collapse the blister against the tablet 12 forcing it through the exposed rupturable foil 14 to dispense the tablet from the package.

However, in accordance with the principles of the present invention, if pressure is applied to the blister in a position in which the tablet 12 is juxtaposed above remaining board 22, the foil layer 14 may not be ruptured nor will the tablet 12 be dispensed. It is this "misregistration" of the removed tab 26 which adds a further degree of child-resistance to the package.

More specifically and in accordance with the principles of the present invention, the supporting layer of paperboard 16 is provided from solid bleached sulfate paperboard having a non-corona treated ½ mil polyethylene coating thereon. This support layer 16 is provided with an appropriate heat seal coating such as a water-based EVA dispersion heat-seal coating applied by using known coating techniques at approximately 1½ lbs. of coating per ream. Such a coating is available from Morton Thiokol Chemical Company under the tradename "Adcote 37R345 Heat Seal Coating". The blister layer 13 is formed from FDA grade polyvinylcholride such as is commercially available from Hoechst Celanese Company under the tradename "Vinyl Mirrex 1025". The rupturable aluminum foil layer 14 is approximately 1 mil thickness having a heat-seal coating which is sealable to various plastic materials. Such a material is commercially available from Reynolds Metal Company under the tradename "Drug Pack 701".

The bottom layer 22 of paperboard is also a solid bleached sulfate having a non-corona treated polyethylene applied thereto to provide a vapor barrier. The bottom layer is sealed to the packette 13 and at its edges to the juxtaposed supporting layer 16 and its tab portions 20 by a special peel-seal coating. The peel-seal coating is a water-based EVA dispersion applied by using any number of known techniques at approximately 0.75 lbs per ream. Such a coating is available from Morton Thikol Chemical Company under the tradename "Adcote 37R987 Primer".

It is to be understood that it is an important aspect of the invention to apply the aforementioned peel-seal coating systems to non-corona treated polyethylene-coated paperboard since the non-treated polyethylene provides a smooth surface and helps to facilitate the peel-seal, which is necessary and desirable to practice the present invention. It will be understood and appreciated by those skilled in the art that were a corona polytreated board employed it would promote the sealability and would interfere with the peelability desirable in this type of package.

It will be apparent to those skilled in the art from the preceding description, that certain changes may be made in the foregoing package without departing from the scope of the invention. Accordingly, it is intended that the descriptive matter hereinabove shall be interpreted as illustrative and in no way limiting, since all equivalents within the scope of this disclosure may be substituted and such substitution is intended to be embraced in the following claims.

We claim:

1. A child-resistant blister package comprising (a) a top sheet of paperboard having a series of oblong apertures defined in central portions thereof;

(b) a thermoformed plastic sheet defining a series of elongated blisters adapted to project through each of said apertures in registry therewith;

(c) a sheet of rupturable material closing off said elongated blisters;

(d) a bottom sheet of paperboard laminated by a peelable laminate to said rupturable sheet material;

(e) said top sheet of paperboard having a severable pull-tab extension projecting beyond the edge of said blisters and beyond the edge of said rupturable material and being directly adhered to said bottom paperboard sheet;

(f) a continuous die cut extending through said bottom sheet of paperboard and defining a removable strip in a manner whereby said bottom strip may be removed from the packaged by grasping said pull-tab and peeling back said pull-tab along with the adhered removal bottom layer to reveal a penetrable limited exposed portion of said rupturable material lying beneath a portion of said aperture;

(g) a tablet within said blister being readily removable therefrom by the application of pressure to specific limited region of said blister along the edge of said blister closest to said pull-tab to rupture said rupturable sheet material, but said tablet not being readily removable from said blister by the application of pressure along the edge of the blister remote from said pull-tab.

2. The package of claim 1 further characterized in that, (a) said rupturable material is aluminum foil having a heat sealable coating applied thereto;

(b) said blister is fabricated from FDA grade plastic; and (c) said paperboard top and bottom sheets being solid bleached sulfate board having a non-corona treated polyethylene coating applied thereto.

* * * * *